US011309117B2

(12) United States Patent
Xia et al.

(10) Patent No.: US 11,309,117 B2
(45) Date of Patent: Apr. 19, 2022

(54) INDUCTIVE ELEMENT AND MANUFACTURING METHOD

(71) Applicant: Shenzhen Sunlord Electronics Co., Ltd., Guangdong (CN)

(72) Inventors: Shengcheng Xia, Guangdong (CN); Youyun Li, Guangdong (CN); Xinshu Yu, Guangdong (CN); Gengxin Xiao, Guangdong (CN)

(73) Assignee: Shenzhen Sunlord Electronics Co., Ltd., Shenzhen (CN)

( * ) Notice: Subject to any disclaimer, the term of this patent is extended or adjusted under 35 U.S.C. 154(b) by 1018 days.

(21) Appl. No.: 15/973,516

(22) Filed: May 7, 2018

(65) Prior Publication Data

US 2019/0295760 A1 Sep. 26, 2019

Related U.S. Application Data

(63) Continuation of application No. PCT/CN2018/079597, filed on Mar. 20, 2018.

(51) Int. Cl.
*H01F 27/24* (2006.01)
*H01F 27/02* (2006.01)
(Continued)

(52) U.S. Cl.
CPC ..... *H01F 27/02* (2013.01); *H01F 1/147* (2013.01); *H01F 27/24* (2013.01); *H01F 27/28* (2013.01);
(Continued)

(58) Field of Classification Search
CPC ..... H01F 27/02; H01F 1/147; H01F 27/24; H01F 27/28; H01F 27/29; H01F 41/0206;
(Continued)

(56) References Cited

U.S. PATENT DOCUMENTS 7,449,984 B2 * 11/2008 Kawarai ..... H01F 41/127 336/83
8,723,629 B1 * 5/2014 Liu ..... H01F 1/14741 336/83
(Continued)

FOREIGN PATENT DOCUMENTS

CN 102856037 A 1/2013
CN 103714945 A 4/2014
(Continued)

*Primary Examiner* — Mang Tin Bik Lian

(57) ABSTRACT

An inductive element includes a magnetic core, a flat coil wound on a middle column of the magnetic core, and a magnetic plastic package layer covering the magnetic core and the flat coil. Two electrodes connected to two pigtails of the flat coil are exposed outside of the magnetic plastic package layer. The flat coil is configured to enable a width direction of a flat wire of the flat coil to be perpendicular to an axial direction of the middle column of the magnetic core, and the flat wire is stacked layer by layer in the axial direction of the middle column. A manufacturing method for the inductive element is also disclosed herein. By using the
(Continued)

wounding method of the flat coil of the inductive element, a height of a product may be reduced while obtaining a same DCR, so that the product is thinner.

8 Claims, 5 Drawing Sheets

(51) Int. Cl.
*H01F 27/28* (2006.01)
*H01F 41/02* (2006.01)
*H01F 1/147* (2006.01)
*H01F 41/061* (2016.01)
*H01F 27/29* (2006.01)

(52) U.S. Cl.
CPC ..... *H01F 27/29* (2013.01); *H01F 41/0206* (2013.01); *H01F 41/061* (2016.01)

(58) Field of Classification Search
CPC ..... H01F 41/061; H01F 27/292; H01F 2017/046; H01F 2017/048; H01F 17/045
See application file for complete search history.

(56) References Cited

U.S. PATENT DOCUMENTS

2006/0038651 A1* 2/2006 Mizushima ..... H01F 17/04 336/83
2009/0051475 A1* 2/2009 Hsueh ..... H01F 17/04 336/83
2011/0005064 A1* 1/2011 Klesyk ..... H01F 27/24 29/605
2014/0259640 A1* 9/2014 Sakamoto ..... H01F 27/022 29/602.1
2016/0086715 A1* 3/2016 Lin ..... C22C 45/02 336/221
2017/0053739 A1* 2/2017 Oki ..... H01F 41/005
2017/0178775 A1* 6/2017 Noguchi ..... C22C 38/18
2017/0221623 A1* 8/2017 Kawarai ..... H01F 27/00
2018/0151284 A1* 5/2018 Sakai ..... H01F 3/10
2018/0294087 A1* 10/2018 Sakai ..... H01F 17/043
2018/0308609 A1* 10/2018 Shinohara ..... B22F 1/02
2018/0308610 A1* 10/2018 Ishida ..... H01F 41/0246

FOREIGN PATENT DOCUMENTS

CN 103915236 A 7/2014
CN 104240898 A 12/2014

* cited by examiner

INDUCTIVE ELEMENT AND MANUFACTURING METHOD

CROSS REFERENCE TO RELATED APPLICATIONS

This application is a continuation application of PCT/CN2018/079597 filed on Mar. 20, 2018. The contents of PCT/CN2018/079597 are all hereby incorporated by reference.

BACKGROUND

Field of the Invention

The present invention relates to an inductive element and a manufacturing method.

Related Arts

With the rapid development of Internet, a requirement on an IC integrated technology becomes higher and higher. Integration and miniaturization are historical development trends. Meanwhile, general requirements on a power inductor include miniaturization, thinness, a high frequency, a low DCR, a large current, a low electromagnetic interference (EMI), and low manufacturing costs. A conventional process-type power inductor, such as an inductor manufactured by means of flying, crossing, and winding of a round wire and an inductor manufactured by means of pair winding of flat wires, has a requirement on the height of a product, and cannot fully use limited space of the power inductor.

For spot welding of a conventional coil and a power inductor on a rack, phenomena such as faulty welding easily occurs to a welding point, and the welding point is buried in a magnetic body, phenomena, such as open circuit or short circuit, also easily occurs during pressing.

For a conventional integrally molded inductor, a coil is first placed in an empty mold cavity, and then the mold cavity is filled with powder for pressing. It is very difficult to ensure that the coil is at a designed position, the coil easily shifts, and a product space utilization is low.

A conventional inductive coil is manufactured by means of pair winding of flat wires. In this winding manner, a width direction of the flat wire is parallel to a middle column of a magnetic core. However, a product has a requirement on a DCR. The width of the flat wire determines an extreme height of a product. Meanwhile, the width of the flat wire is generally at least 1.5 times of the thickness. Consequently, the height of the product cannot be too low.

The Related Arts disclosed above is merely used for assisting in understanding the inventive concept and the solutions of the present invention, and does not necessarily belong to the prior art of this patent application. When there is no exact evidence indicating that the foregoing content is disclosed on the application date of this patent application, the Related Arts should be not be used to evaluate the novelty and the creativity of this application.

SUMMARY

A main objective of the present invention is to provide an inductive element and a manufacturing method for disadvantages of the prior art.

To achieve the purpose, the following solutions are used in the present invention:

An inductive element includes a magnetic core, a flat coil wound on a middle column of the magnetic core, and a magnetic plastic package layer covering the magnetic core and the flat coil, where two electrodes connected to two pigtails of the flat coil are exposed outside of the magnetic plastic package layer, the flat coil is configured to enable a width direction of a flat wire of the flat coil to be perpendicular to an axial direction of the middle column of the magnetic core, and the flat wire is stacked layer by layer in the axial direction of the middle column.

Further, the magnetic plastic package layer is molded or is formed by means of rubber coating.

Further, the magnetic plastic package layer includes magnetic powder particles, an organic adhesive, a lubricant, and a curing agent, a material of the magnetic powder particles includes any one or more of MnZn, NiZn, carbonyl iron powder, ferronickel alloy, FeSi, FeSiCr, FeSiAl, molybdenum permalloy, nano-crystalline, and noncrystalline, the organic adhesive includes any one or more of epoxy resin, silicon resin, furfural resin, polyimide, polyphenylene sulfide, and melamine resin, the lubricant includes any one or more of stearic acid, aluminum stearate, magnesium stearate, calcium stearate, and zinc stearate, and preferably, the curing agent is amine resin.

Further, an entire shape of the magnetic core is T-shaped, bar-shaped, or I-shaped.

Further, a cross sectional shape of the middle column of the magnetic core is a square, a rectangle, an ellipse, a circle, or racetrack-shaped.

Further, the magnetic core is a T-shaped magnetic core, the T-shaped magnetic core includes a lower blade and the middle column of the magnetic core that is connected to the lower blade, the flat coil is wound on the middle column of the magnetic core, the magnetic plastic package layer covers the flat coil and the magnetic core, but an outer side of and at least a part of a bottom of the lower blade of the magnetic core are exposed outside, to facilitating disposing the electrodes.

Further, the magnetic core is an I-shaped magnetic core, the I-shaped magnetic core includes an upper blade, a lower blade, and the middle column of the magnetic core that is connected to and between the upper blade and the lower blade, the flat coil is wound on the middle column of the magnetic core, the magnetic plastic package layer covers the flat coil and the magnetic core, and an outer side of and at least a part of a bottom of the lower blade of the magnetic core are exposed outside, to facilitating disposing the electrodes.

Further, a bottom of the magnetic core is provided with two electrode grooves, metalization layers are formed in the electrode grooves, the two pigtails of the flat coil wound on the middle column of the magnetic core are respectively placed inside each of the two electrode grooves, and the pigtails are fixed in the electrode grooves by means of spot welding; or both a side face and a bottom of the magnetic core are each provided with two electrode grooves, metalization layers are formed in the electrode grooves, the two electrode grooves on the side face of the magnetic core are respectively connected to the two electrode grooves at the bottom of the magnetic core by using the metalization layers, the two pigtails of the flat coil wound on the middle column of the magnetic core are respectively placed inside each of the two electrode grooves on the side face of the magnetic core, and the pigtails are fixed in the electrode grooves by means of spot welding.

A manufacturing method for the inductive element includes the following steps:

a. prefabricating a magnetic core and winding a flat coil on a middle column of the magnetic core, and respectively connecting two pigtails of the flat coil to two electrodes disposed on the magnetic core; and b. covering the magnetic core and the flat coil with a magnetic plastic package layer, and making the electrodes connected to the flat coil be exposed outside of the magnetic plastic package layer, where when the flat coil is wound in step a, a width direction of a flat wire is enabled to be perpendicular to an axial direction of the middle column of the magnetic core, and the flat wire is stacked layer by layer in the axial direction of the middle column, to form the flat coil.

Further, step b includes: preparing a magnetic plastic package material, where magnetic powder included in the magnetic plastic package layer is carbonyl iron powder on which passivation and insulation processing is performed, and preferably, a particle size D50 of the carbonyl iron powder is 4 μm; solids content in the magnetic powder of the magnetic plastic package layer is between 60 wt % and 90 wt %; the organic adhesive includes silicon resin and epoxy resin, and content is between 10 wt % and 40 wt %; preferably, the curing agent is amine resin, and preferably, usage of the curing agent is 6 wt % of silicon resin content; preferably, magnesium stearate accounting for 0.2 wt % of a total weight is also added, to perform homogenization; and forming the magnetic plastic package layer at a periphery of the coil by using the prepared magnetic plastic package material and by means of molding process, preferably, a molding pressure being between 0 MPa to 100 MPa, and then performing baking with 150° C./1 H, to cure an organic component in the magnetic plastic package layer; or step b includes: preparing a magnetic plastic package material, where magnetic powder included in the magnetic plastic package layer is FeSiCr metal soft magnetic powder on which passivation and insulation processing is performed, and preferably, a particle size D50 of the FeSiCr metal soft magnetic powder is 30 μm; solids content in the magnetic powder of the magnetic plastic package layer is between 80 wt % and 97 wt %; the organic adhesive includes silicon resin, and content is between 3 wt % and 20 wt %; preferably, the curing agent is amine resin, and preferably, usage of the curing agent is 6 wt % of silicon resin content; and forming the magnetic plastic package layer at a periphery of the coil by using the prepared magnetic plastic package material and by means of molding process, preferably, a molding pressure being between 100 MPa to 300 MPa, and then performing baking with 150° C./1 H, to cure an organic component in the magnetic plastic package layer.

The present invention has the following beneficial effects:

According to the present invention, in the inductive element, the flat coil is configured to enable the width direction of the flat wire of the flat coil to be perpendicular to the axial direction of the middle column of the magnetic core, and the flat wire is stacked layer by layer in the axial direction of the middle column. Therefore, distinguishing from a conventional winding manner in which the width direction of the flat wire is enabled to be parallel to the axial direction of the middle column of the magnetic core, a width of the flat wire determines the height of a product. According to the present invention, a winding manner in which the width direction of the flat wire is enabled to be perpendicular to the axial direction of the middle column of the magnetic core is used, and the thickness of the flat wire determines the height of a product. However, the width of the flat wire is at least 1.5 times of the thickness. When a same DCR is obtained, the winding manner of the flat coil of the inductive element in the present invention can better reduce the height of the product, so that the product is thinner. In this manner, the coil is wound on the prefabricated magnetic core, so that the coil is fixed, and the coil does not shift or deform during later molding/injection, thereby fully using effective space of a magnetic body while improving the consistency of the product. A pin of the coil directly forms an electrode, to greatly reduce a rick of open circuit and improve the reliability of the product. The present invention may provide a magnetic core having a large magnetic permeability, for example, between 40 and 500. When an Inductance the same as that of a integrally molded inductor is achieved, in the present invention, a pressure for molding of the magnetic plastic package layer may be properly reduced, for example, between 0 MPa and 300 MPa. A power inductor product provided in the present invention has requirements on thinness and miniaturization, a wire diameter of a built-in coil is required to be thinner. The forming pressure of the magnetic plastic package layer in the present invention is relatively low, so that it is more suitable for implementing thinness and miniaturization of the power inductor product.

The above widely clarifies the features and technical advantages of the present invention, to facilitate better understanding detailed descriptions of the present invention. Other features and advantages of the present invention are described below.

DETAILED DESCRIPTION

Figure 1:
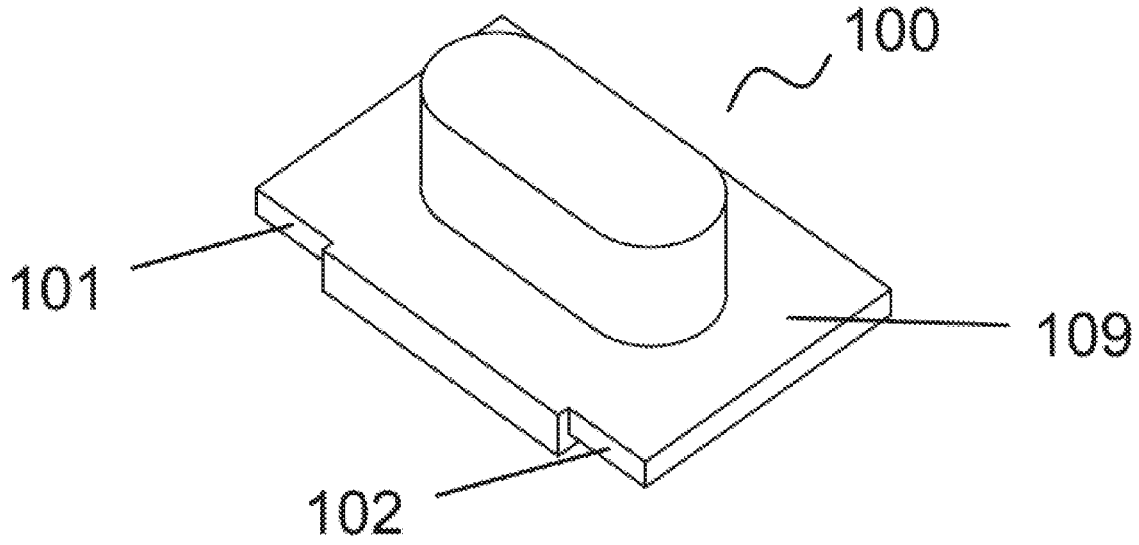
FIG. 1 is a schematic diagram of a prefabricated T-shaped magnetic core according to an embodiment of the present invention.

The present invention is described in further detail below with reference to embodiments and the accompanying drawings. It should be emphasized that the following descriptions are merely exemplary, but are not intended to limit the scope and application of the present invention. Persons skilled in the art should understand that, the disclosed concept and specific embodiments may be easily used as basis for modifying or designing another structure, to achieve a same purpose of the present invention. Persons skilled in the art also should know that such equivalent constitution does not deviate from the spirit and scope of the present invention. For a novel feature considered as a feature of the present invention, a structure, an operation method, and a further purpose and advantage of the novel feature will be better understood based on the following descriptions and with reference to the accompanying drawings. However, it should be deeply known that, each feature is provided merely for description and illustration, but is not intended to limit the definition of the present invention.

Referring to FIG. 1 to FIG. 9, in some embodiments, an inductive element includes magnetic core 100 (200), a flat coil 110 (210) wound on a middle column 105 (203) of the magnetic core 100 (200), and a magnetic plastic package layer 108 (205) covering the magnetic core and the flat coil 110 (210). Two electrodes connected to two pigtails 106 and 107 (201 and 202) of the flat coil 110 (210) are exposed outside of the magnetic plastic package layer 108 (205). The flat coil 110 (210) is configured to enable width directions of the flat wire of the flat coil 110 (210) to be perpendicular to the axial direction of the middle column 105 (203) of the magnetic core, and the flat wire is stacked layer by layer in the axial direction of the middle column 105 (203). In a preferred embodiment, the magnetic plastic package layers 108 and 205 are molded or are formed by means of rubber coating.

In a preferred embodiment, the magnetic plastic package layer 108, 205 includes magnetic powder particles, an organic adhesive, a lubricant, and a curing agent.

In a further preferred embodiment, a material of the magnetic powder particles may include (but is not limited to) any one or more of MnZn, NiZn, carbonyl iron powder, ferronickel alloy, FeSi, FeSiCr, FeSiAl, molybdenum permalloy, nano-crystalline, and noncrystalline.

In a further preferred embodiment, the organic adhesive may include (but is not limited to) any one or more of epoxy resin, silicon resin, furfural resin, polyimide, polyphenylene sulfide, and melamine resin.

In a further preferred embodiment, the lubricant may include (but is not limited to) any one or more of stearic acid, aluminum stearate, magnesium stearate, calcium stearate, and zinc stearate.

In a further preferred embodiment, the curing agent may include (but is not limited to) amine resin.

Referring to FIG. 1 to FIG. 9, in a preferred embodiment, entire shapes of the magnetic cores 100 and 200 may be (but is not limited to) T-shaped, bar-shaped, or I-shaped.

Further, cross sectional shapes of the middle columns of the magnetic cores may be (but is not limited to) squares, rectangles, ellipses, circles, or racetrack-shaped.

Referring to FIG. 1 to FIG. 5, in a preferred embodiment, the magnetic core 100 may be a T-shaped magnetic core. The T-shaped magnetic core includes a lower blade 109 and the middle column 105 of the magnetic core that is connected to the lower blade. The flat coil 110 is wound on the middle column 105 of the magnetic core, and the magnetic plastic package layer 108 covers the flat coil and the magnetic core, but an outer side of and at least a part of a bottom of the lower blade of the magnetic core are exposed outside, to facilitate disposing the electrodes.

Referring to FIG. 6 to FIG. 9, in another preferred embodiment, the magnetic core 200 may be an I-shaped magnetic core. The I-shaped magnetic core includes an upper blade 207, a lower blade 204, and the middle column 203 of the magnetic core that is connected to and that is between the upper blade 207 and the lower blade 204. The flat coil 210 is wound on the middle column 203 of the magnetic core, and the magnetic plastic package layer 205 covers the flat coil and the magnetic core. An outer side of and at least a part of a bottom of the lower blade of the magnetic core are exposed outside, to facilitate disposing the electrodes.

In a preferred embodiment, a bottom of the magnetic core is provided with two electrode grooves 103 and 104. Metalization layers are formed in the electrode groove 103 and 104, the two pigtails of the flat coil wound on the middle column of the magnetic core are respectively placed inside each of the two electrode grooves 103 and 104, and the pigtails are fixed in the electrode grooves 103 and 104 by means of spot welding.

In another preferred embodiment, both a side face and a bottom of the magnetic core are each provided with two electrode grooves 101, 102, 103, and 104. Metalization layers are formed in the electrode grooves 101, 102, 103, and 104. The two electrode grooves 101 and 102 on the side face of the magnetic core are respectively connected to the two electrode grooves 103 and 104 at the bottom of the magnetic core by using the metalization layers, the two pigtails of the flat coil wound on the middle column of the magnetic core are respectively placed inside each of the two electrode grooves 101 and 102 on the side face of the magnetic core, and the pigtails are fixed in the electrode grooves by means of spot welding.

Referring to FIG. 1 to FIG. 8, in another embodiment, a manufacturing method for the inductive element includes the following steps:

a. prefabricating a magnetic core and winding a flat coil on a middle column of the magnetic core, and respectively connecting two pigtails of the flat coil to two electrodes disposed on the magnetic core; and b. covering the magnetic core and the flat coil with a magnetic plastic package layer, and making the electrodes connected to the flat coil be exposed outside of the magnetic plastic package layer, where when the flat coil is wound in step a, a width direction of a flat wire is enabled to be perpendicular to an axial direction of the middle column of the magnetic core, and the flat wire is stacked layer by layer in the axial direction of the middle column, to form the flat coil.

In some preferred embodiments, step b includes: preparing a magnetic plastic package material, where magnetic powder included in the magnetic plastic package layer is carbonyl iron powder on which passivation and insulation processing is performed, and preferably, a particle size D50 of the carbonyl iron powder is 4 μm; solids content in the magnetic powder of the magnetic plastic package layer is between 60 wt % and 90 wt %; the organic adhesive includes silicon resin and epoxy resin, and content is between 10 wt % and 40 wt %; preferably, the curing agent is amine resin, and preferably, usage of the curing agent is 6 wt % of silicon resin content; preferably, magnesium stearate accounting for 0.2 wt % of a total weight is also added, to perform homogenization; and forming the magnetic plastic package layer at a periphery of the coil by using the prepared magnetic plastic package material and by means of molding process, preferably, a molding pressure being between 0

MPa to 100 MPa, and then performing baking with 150° C./1 H, to cure an organic component in the magnetic plastic package layer.

In other some preferred embodiments, step b includes: preparing a magnetic plastic package material, where magnetic powder included in the magnetic plastic package layer is FeSiCr metal soft magnetic powder on which passivation and insulation processing is performed, and preferably, a particle size D50 of the FeSiCr metal soft magnetic powder is 30 μm; solids content in the magnetic powder of the magnetic plastic package layer is between 80 wt % and 97 wt %; the organic adhesive includes silicon resin, and content is between 3 wt % and 20 wt %; preferably, the curing agent is amine resin, and preferably, usage of the curing agent is 6 wt % of silicon resin content; and forming the magnetic plastic package layer at a periphery of the coil by using the prepared magnetic plastic package material and by means of molding process, preferably, a molding pressure being between 100 MPa to 300 MPa, and then performing baking with 150° C./1 H, to cure an organic component in the magnetic plastic package layer.

In some specific embodiments, a small-size product of 1.0*0.5*0.65 mm may be manufactured by using the method of the present invention. In the foregoing winding manner, the flat wire is wound on the middle column of the prefabricated magnetic core, forming the flat coil, and pins are placed in specified positions. The pins are fixed in electrode grooves by means of spot welding. The electrode grooves may be on a side face of the magnetic core, or may be on a bottom of the magnetic core. The magnetic plastic package material may cover the magnetic core and the coil by means of molding or by means of rubber coating, and the pins of the coil are exposed outside. The magnetic plastic package layer may include magnetic powder particles, an organic adhesive, a lubricant, a curing agent, and the like. A material of the magnetic powder particles may include any one or more of MnZn, NiZn, carbonyl iron powder, ferronickel alloy, FeSi, FeSiCr, FeSiAl, molybdenum permalloy, nanocrystalline, and noncrystalline. The organic adhesive may include any one or more of epoxy resin, silicon resin, furfural resin, polyimide, polyphenylene sulfide, and melamine resin. The lubricant includes stearic acid, aluminum stearate, magnesium stearate, calcium stearate, and zinc stearate, but is not limited to the types. The prefabricated magnetic core may be made of ferrite or a metal soft magnetic material according to an actual manufacturing requirement and product performance, and the shape of the magnetic core may also arbitrarily change. The prefabricated magnetic core may be manufactured by means of an existing, conventional, and universally applicable injection, compression molding, or engraving process. A manner in which the coil is placed in the prefabricated magnetic core may be that a built-in coil winding is formed by means of winding on an original position of the magnetic core. Another manner is that the coil is first manufactured, and then the coil is placed in the prefabricated magnetic core, to form a built-in coil winding.

An entire shape of the prefabricated magnetic core may be T-shaped, bar-shaped, or I-shaped; and a cross sectional shape of the middle column of the magnetic core may be a square, a rectangle, an ellipse, a circle, or racetrack-shaped.

The prefabricated magnetic core may be a T-shaped the magnetic core. The T-shaped magnetic core includes a lower blade and a middle column of the magnetic core. The magnetic plastic package layer covers a part (including a side of an I-shaped base extending from the middle column of the magnetic core) of the lower blade and the middle column of the magnetic core, and an outer side and a bottom of the lower blade of the magnetic core are exposed outside.

The prefabricated magnetic core may alternatively be an I-shaped magnetic core. The I-shaped magnetic core includes an upper blade, a lower blade, and a middle column of the magnetic core. The magnetic plastic package layer covers the upper blade, a part of the lower blade, and the middle column that are of the magnetic core. An outer side and a bottom of the lower blade of the magnetic core are exposed outside.

A bottom of a T-shaped magnetic core or an I-shaped magnetic core may be provided with two electrode grooves. Preferably, the two electrode grooves are disposed in parallel. Metalization layers are formed in the electrode grooves. Two pigtails of a coil wound on a middle column of the magnetic core are respectively placed in each of the two electrode grooves. Alternatively, a side face of the I-shaped or T-shaped magnetic core is provided with two electrode grooves, and a bottom of the magnetic core is provided with two electrode grooves/electrode layers. Metalization layers are formed in the electrode grooves. The two electrode grooves on the side face of the magnetic core are connected to the two electrode grooves/electrode layers at the bottom of the magnetic core by using the metalization layers. Two pigtails wound on the flat coil of the middle column of the magnetic core are respectively placed in each of the two electrode grooves on the side face of the magnetic core.

Example 1

Figure 2:
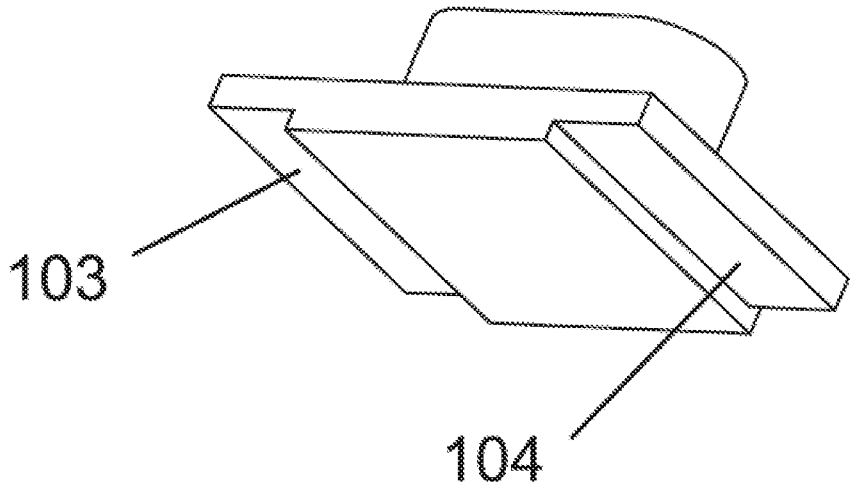
FIG. 2 is a schematic diagram of electrode grooves at a bottom of a T-shaped magnetic core according to an embodiment of the present invention.

As shown in FIG. 1, a T-shaped magnetic core made of a FeSiCr material may be manufactured by using a compression molding process once. Preferably, a magnetic permeability is between 40 and 150, and saturation flux is between 10000 mT and 15000 mT. Preferably, as shown in FIG. 2, a bottom of the magnetic core is provided with two parallel electrode grooves 103 and 104, and a side face is provided with two hanging slots or two electrode grooves 101 and 102. Metalization layers are formed in the electrode grooves by preferably using a sputter process.

Figure 3:
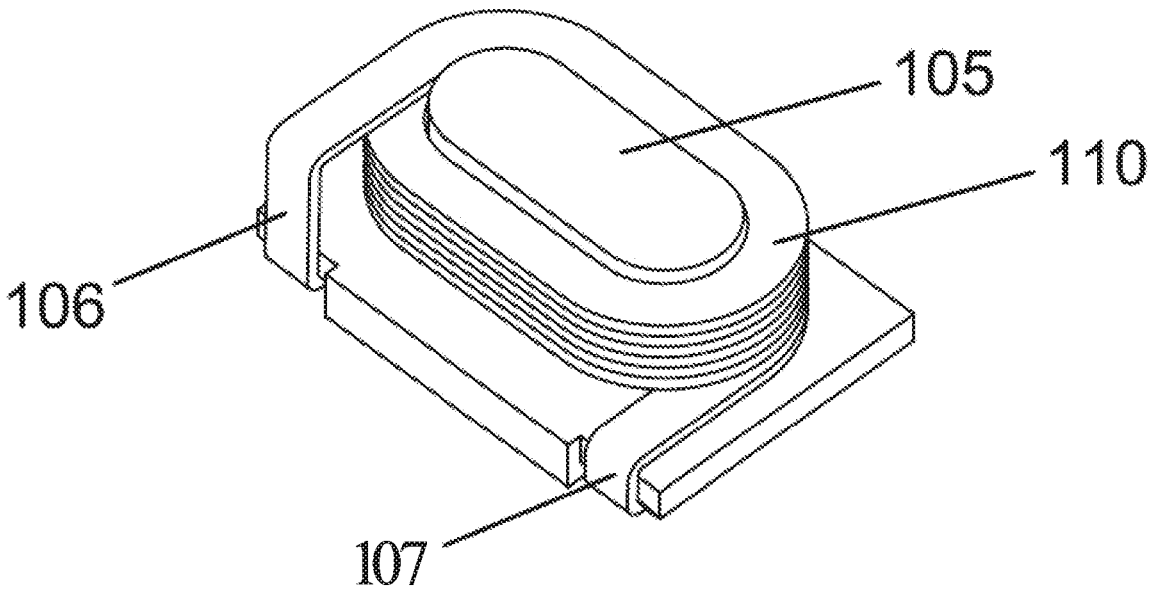
FIG. 3 is a schematic diagram of a built-in winding formed by winding a coil of (T-shaped magnetic core) on a prefabricated magnetic core according to an embodiment of the present invention.

Winding may be performed on a middle column 105 of the T-shaped magnetic core by using a winding machine. As shown in FIG. 3, preferably, after a coil is wound, pigtails 106 and 107 of the coil are placed in the electrode grooves 103 and 104.

Figure 4:
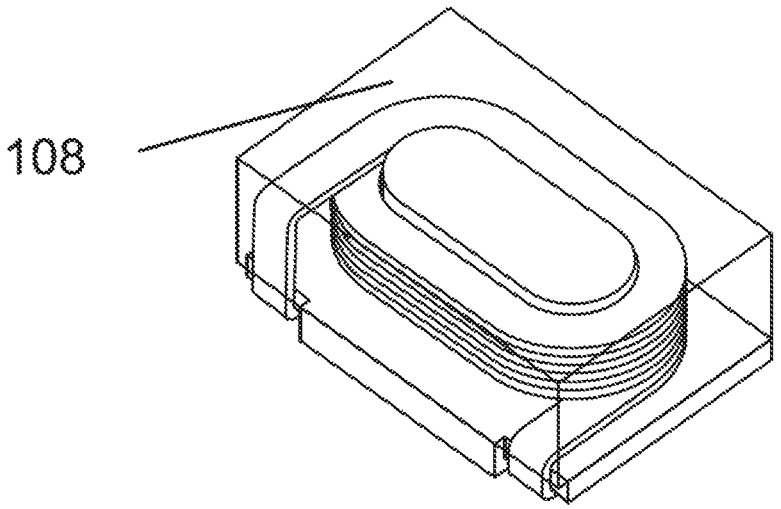
FIG. 4 is a schematic diagram of a formed magnetic plastic package layer of (T-shaped magnetic core) according to an embodiment of the present invention.

FIG. 4 is a schematic diagram of a finished product formed after potting of magnetic rubber. The wound magnetic core is covered by a magnetic plastic package layer 108 by means of molding. The magnetic plastic package layer 108 covers the middle column 105 of the magnetic core and a part (an upper surface) of a lower blade 109, and a bottom of the lower blade is exposed outside of the magnetic core.

Figure 5:
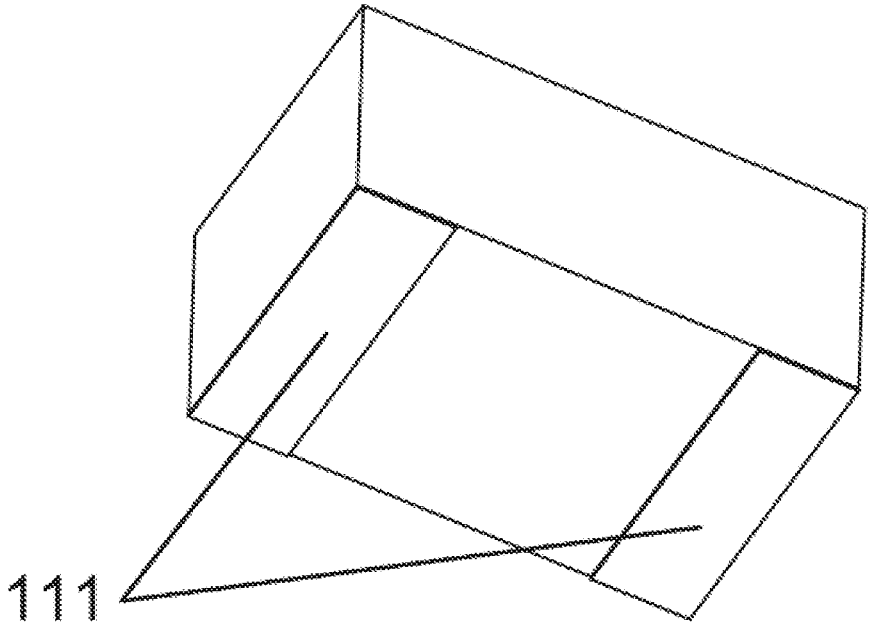
FIG. 5 is an outline drawing of a finished product of (T-shaped magnetic core) according to an embodiment of the present invention.

Magnetic powder included in the magnetic plastic package layer 108 is preferably carbonyl iron powder. Passivation and insulation processing is performed on original powder, and a particle size D50 is preferably 4 μm. Solids content of magnetic powder of a magnetic plastic package material is preferably between 60 wt % and 90 wt %. An organic adhesive preferably include silicon resin and epoxy resin, and content is preferably between 10 wt % and 40 wt %. A curing agent is preferably amine resin, and usage of the curing agent is preferably 6 wt % of silicon resin content. Preferably, magnesium stearate accounting for 0.2 wt % of a total weight is also added, to perform homogenization. By using the prepared magnetic plastic package material and by means of molding process, the magnetic plastic package layer is formed on the magnetic core and the coil that are shown in FIG. 3. A molding pressure is preferably between 0 MPa to 100 MPa, and then baking with 150° C./1 H is preferably performed, to cure an organic component in the magnetic plastic package layer. Preferably, an external electrode terminal 111 for an SMD is formed by using a method such as metalization of molten copper or PVD sputtering. FIG. 5 is an outline drawing of a finished product according to a preferred embodiment.

Example 2

Figure 6:
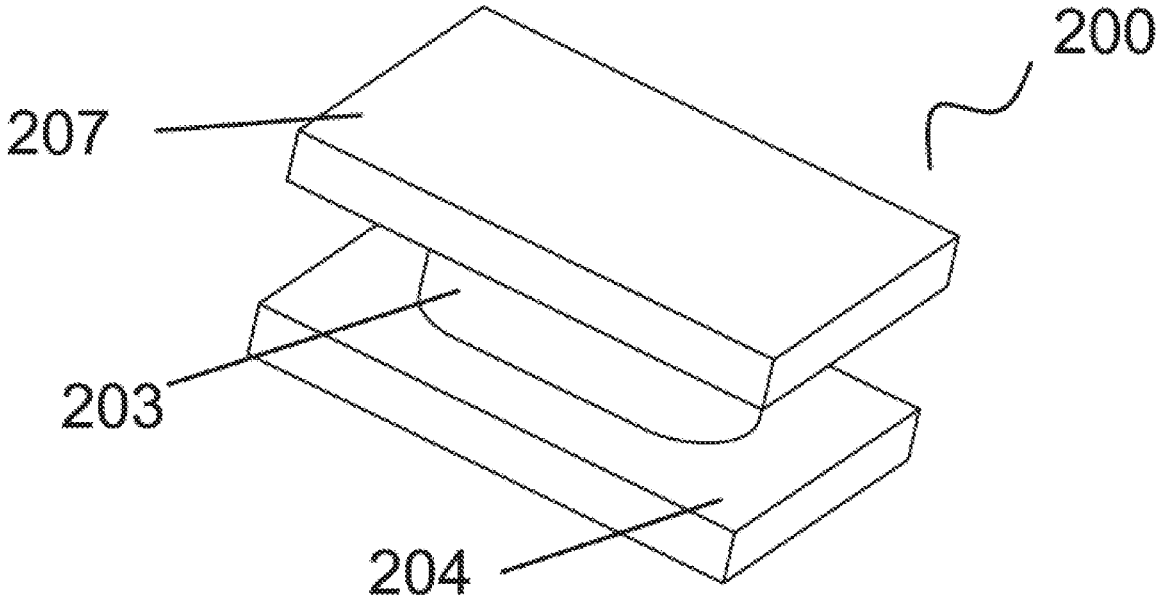
FIG. 6 is a schematic diagram of a prefabricated I-shaped magnetic core according to an embodiment of the present invention.

As shown in FIG. 6, an I-shaped magnetic core made of metal soft magnetic alloy may also be prefabricated by using a powder molding process once. Preferably, a magnetic permeability is between 40 and 90, saturation flux is between 10000 mT and 15000 mT, and a material of the I-shaped magnetic core is preferably carbonyl iron powder.

Figure 7:
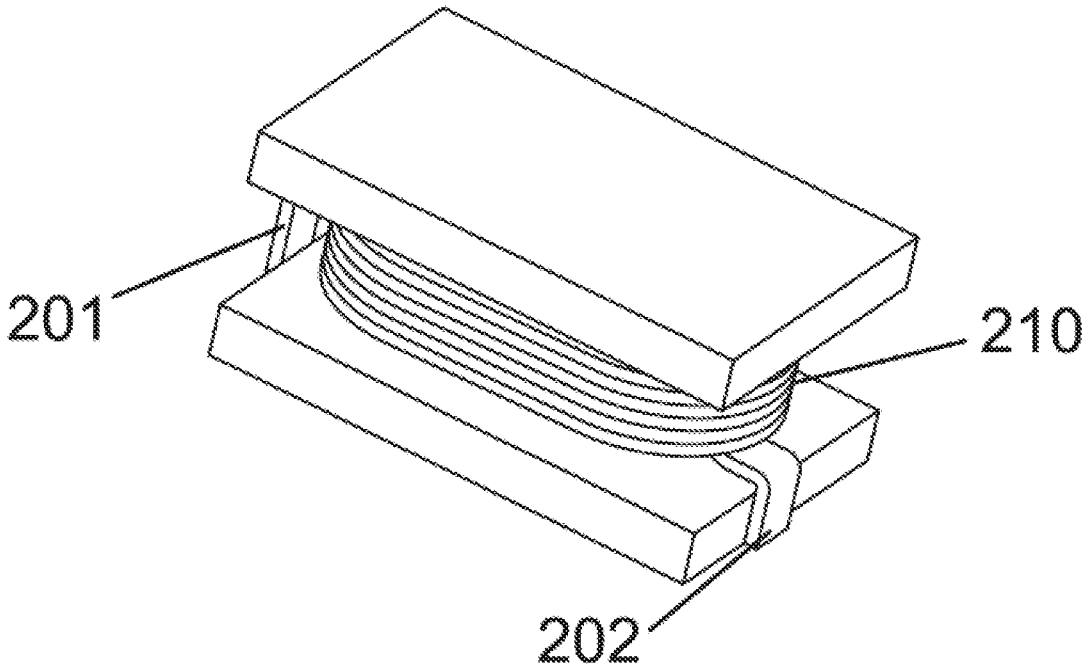
FIG. 7 is a schematic diagram of winding of a flat coil on (an I-shaped magnetic core) according to an embodiment of the present invention.

A base of the prefabricated I-shaped magnetic core may be rectangular. As shown in FIG. 7, a flat coil is wound on a middle column 203 of the prefabricated magnetic core by using a winding machine. The flat coil has two pigtails 201 and 202. The two pigtails 201 and 202 are respectively bent and clinging to two sides of a lower blade 204 of the I-shaped magnetic core. Then, the two pigtails 201 and 202 are welded on a metalization layer on a side face by means of laser welding, forming a structure shown in FIG. 7.

Figure 8:
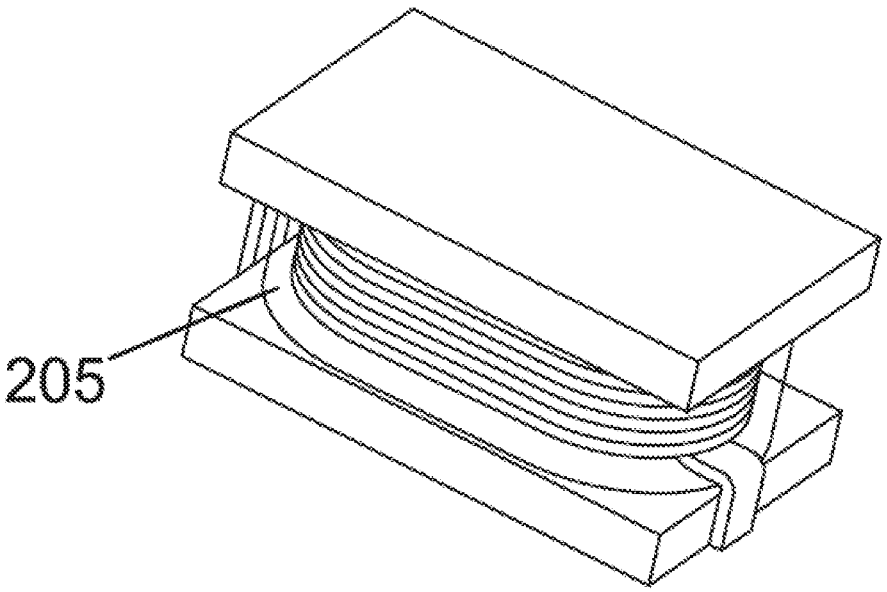
FIG. 8 is a schematic diagram of a built-in winding formed by vertically winding a coil (of an I-shaped magnetic core) on a prefabricated magnetic core according to an embodiment of the present invention.
Figure 9:
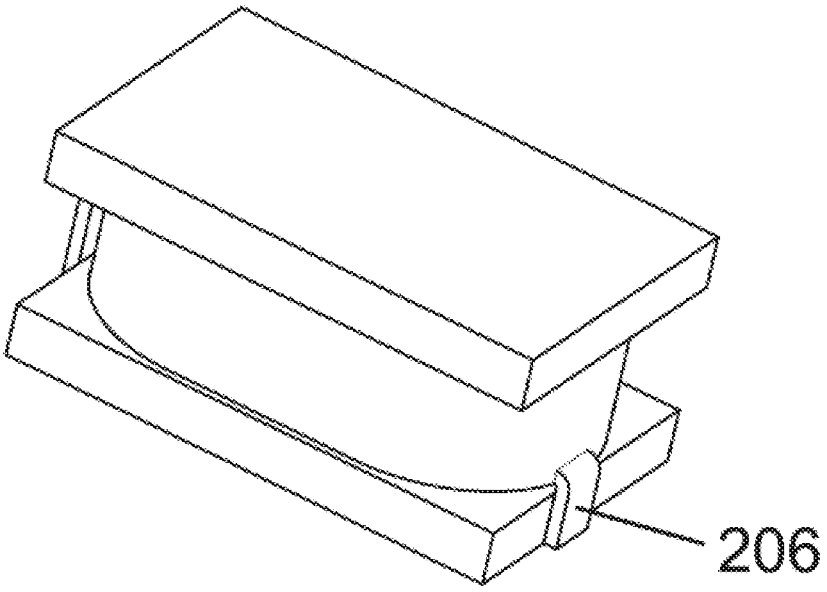
FIG. 9 is a schematic diagram of a product after a magnetic plastic package layer of (an I-shaped magnetic core) is formed according to an embodiment of the present invention.

FIG. 8 is a schematic diagram of the flat coil wrapped by a magnetic glue coating layer 205. FIG. 9 is a schematic diagram of a formed finished product. The I-shaped magnetic core wound with the coil is covered by the magnetic glue coating layer 205 by means of rubber coating.

Magnetic powder included in the magnetic plastic package layer 205 is FeSiCr metal soft magnetic powder. Passivation and insulation processing is performed on original powder, and a particle size D50 is preferably 30 μm. Solids content in the magnetic powder of the magnetic plastic package material is preferably between 80 wt % and 97 wt %. An organic adhesive preferably includes silicon resin, and content is preferably between 3 wt % and 20 wt %. A curing agent is preferably amine resin, and usage of the curing agent is preferably 6 wt % of silicon resin content. By using the prepared magnetic plastic package material and by means of molding process, the magnetic plastic package layer 205 is formed at a periphery of a coil winding shown in FIG. 2C. A molding pressure is preferably between 100 MPa to 300 MPa, and then baking with 150° C./1 H is preferably performed, to cure an organic component in the magnetic plastic package layer. Preferably, a conductive adhesive is finally applied at welding points of pigtails 201 and 202, and a conducting layer 206 is formed after the adhesive is heated and cured. FIG. 9 is an outline drawing of a finished product according to a preferred embodiment.

The inductive element in the present invention is applicable to electronic products, such as digital cameras, mobile phones, computers, televisions, set top boxes, game consoles, car electronics, and LED lighting. The power inductor product has advantages, such as thinness, miniaturization, and high reliability.

Although the present invention is described above in further detail through specific/preferred implementations, the present invention is not limited to the specific/preferred implementations. It should be understood by persons of ordinary skill in the art that some replacements or variations made to the described implementations without departing from the concept of the present invention shall fall within the protection scope of the present invention. In description of this specification, description of the reference term such as "an embodiment", "some embodiments", "a preferred embodiment", "an example", "a specific example", or "some examples" means that a specific feature, a structure, a material or a characteristic that is described with reference to the embodiment or example is included in at least one embodiment or example of the present disclosure. In this specification, schematic description of the foregoing terms is unnecessarily for a same embodiment or example. Moreover, the described specific feature, structure, material or characteristic may be combined in any proper manner in any one or multiple embodiments or examples. In addition, persons skilled in the art may integrate and combine different embodiments or examples described in this specification or features thereof as long as no conflict occurs. Although the embodiments and advantages of the present disclosure is described in detail, it should be understood that various variations, replacements, and modifications may be made to this specification without departing from the embodiment spirit and scope that are limited by CLAIMS. In addition, the scope of the present invention is not intended to be limited by the specific embodiments of processes, machines, manufacturing, material composition, means, methods, and steps described in this specification. Persons of ordinary skills in the art will easily understand that, they may use the foregoing disclosure, processes, machines, manufacturing, material composition, means, methods, or steps that currently exist or that are to be developed later, to perform a function basically the same as that of a corresponding embodiment in this specification or obtain a result basically the same as that of an embodiment in this specification. Therefore, CLAIMS is intended to include the processes, machines, manufacturing, material composition, means, methods, or steps.

What is claimed is:

1. An inductive element, comprising a magnetic core, a flat coil wound on a middle column of the magnetic core, and a magnetic plastic package layer covering the magnetic core and the flat coil, wherein two electrodes are connected to two pigtails of the flat coil and the electrodes are exposed outside of the magnetic plastic package layer, the flat coil is configured to enable a width direction of a flat wire of the flat coil to be perpendicular to an axial direction of the middle column of the magnetic core, and the flat wire is stacked layer by layer in the axial direction of the middle column; wherein the magnetic plastic package layer comprises magnetic powder, an organic adhesive, a lubricant, and a curing agent, wherein the lubricant comprises any one or more of stearic acid, aluminum stearate, magnesium stearate, calcium stearate, and zinc stearate;

wherein the magnetic powder comprised in the magnetic plastic package layer is carbonyl iron powder on which passivation and insulation processing is performed, and a particle size D50 of the carbonyl iron powder is 4 μm; solids content in the magnetic powder of the magnetic plastic package layer is between 60 wt % and 90 wt %; the organic adhesive comprises silicon resin and epoxy resin, and content is between 10 wt % and 40 wt %; the curing agent is amine resin, and usage of the curing agent is 6 wt % of silicon resin content the lubricant is magnesium stearate accounting for 0.2 wt % of a total weight; or wherein the magnetic powder comprised in the magnetic plastic package layer is FeSiCr metal soft magnetic powder on which passivation and insulation processing is performed, and a particle size D50 of the FeSiCr metal soft magnetic powder is 30 μm; solids content in the magnetic powder of the magnetic plastic package layer is between 80 wt % and 97 wt %; the organic adhesive comprises silicon resin, and content is between 3 wt % and 20 wt %; the curing agent is amine resin, and usage of the curing agent is 6 wt % of silicon resin content.

2. The inductive element according to claim 1, wherein the magnetic plastic package layer is molded or is formed by means of rubber coating.

3. The inductive element according to claim 1, wherein an entire shape of the magnetic core is T-shaped, bar-shaped, or I-shaped.

4. The inductive element according to claim 1, wherein a cross sectional shape of the middle column of the magnetic core is a square, a rectangle, an ellipse, a circle, or racetrack-shaped.

5. The inductive element according to claim 1, wherein the magnetic core is a T-shaped magnetic core, the T-shaped magnetic core comprises a lower blade and the middle column of the magnetic core that is connected to the lower blade, the flat coil is wound on the middle column of the magnetic core, the magnetic plastic package layer covers the flat coil and the magnetic core, but an outer side of and at least a part of a bottom of the lower blade of the magnetic core are exposed outside, to facilitating disposing the electrodes.

6. The inductive element according to claim 1, wherein the magnetic core is an I-shaped the magnetic core, the I-shaped magnetic core comprises an upper blade, a lower blade, and the middle column of the magnetic core that is connected to and between the upper blade and the lower blade, the flat coil is wound on the middle column of the magnetic core, the magnetic plastic package layer covers the flat coil and the magnetic core, and an outer side of and at least a part of a bottom of the lower blade of the magnetic core are exposed outside, to facilitating disposing the electrodes.

7. The inductive element according to claim 1, wherein a bottom of the magnetic core is provided with two electrode grooves, metalization layers are formed in the electrode grooves, the two pigtails of the flat coil wound on the middle column of the magnetic core are respectively placed inside each of the two electrode grooves, and the pigtails are fixed in the electrode grooves by means of spot welding; or both a side face and a bottom of the magnetic core are each provided with two electrode grooves, metalization layers are formed in the electrode grooves, the two electrode grooves on the side face of the magnetic core are respectively connected to the two electrode grooves at the bottom of the magnetic core by using the metalization layers, the two pigtails of the flat coil wound on the middle column of the magnetic core are respectively placed inside each of the two electrode grooves on the side face of the magnetic core, and the pigtails are fixed in the electrode grooves by means of spot welding.

8. A manufacturing method for the inductive element according to claim 1, comprising the following steps:

a. prefabricating the magnetic core and winding the flat coil on the middle column of the magnetic core, and respectively connecting the pigtails of the flat coil to the electrodes disposed on the magnetic core; and b. covering the magnetic core and the flat coil with a magnetic plastic package layer, and making the electrodes connected to the flat coil be exposed outside of the magnetic plastic package layer, wherein when the flat coil is wound in step a, the width direction of the flat wire is enabled to be perpendicular to the axial direction of the middle column of the magnetic core, and the flat wire is stacked layer by layer in the axial direction of the middle column, to form the flat coil;

wherein step b comprises: preparing a magnetic plastic package material, wherein magnetic powder comprised in the magnetic plastic package layer is carbonyl iron powder on which passivation and insulation processing is performed, and a particle size D50 of the carbonyl iron powder is 4 μm; solids content in the magnetic powder of the magnetic plastic package layer is between 60 wt % and 90 wt %; the organic adhesive comprises silicon resin and epoxy resin, and content is between 10 wt % and 40 wt %; the curing agent is amine resin, and usage of the curing agent is 6 wt % of silicon resin content magnesium stearate accounting for 0.2 wt % of a total weight is also added, to perform homogenization; and forming the magnetic plastic package layer at a periphery of the coil by using the prepared magnetic plastic package material and by means of molding process, a molding pressure being between 0 MPa to 100 MPa, and then performing baking with 150° C./1 H, to cure an organic component in the magnetic plastic package layer; or step b comprises: preparing a magnetic plastic package material, wherein magnetic powder comprised in the magnetic plastic package layer is FeSiCr metal soft magnetic powder on which passivation and insulation processing is performed, and a particle size D50 of the FeSiCr metal soft magnetic powder is 30 μm; solids content in the magnetic powder of the magnetic plastic package layer is between 80 wt % and 97 wt %; the organic adhesive comprises silicon resin, and content is between 3 wt % and 20 wt %; the curing agent is amine resin, and usage of the curing agent is 6 wt % of silicon resin content and forming the magnetic plastic package layer at a periphery of the coil by using the prepared magnetic plastic package material and by means of molding process, a molding pressure being between 100 MPa to 300 MPa, and then performing baking with 150° C./1 H, to cure an organic component in the magnetic plastic package layer.

* * * * *